US011709026B1

(12) United States Patent
Hoffman

(10) Patent No.: US 11,709,026 B1
(45) Date of Patent: Jul. 25, 2023

(54) REMOVAL ASSIST MECHANISM FOR FIRE ARM MAGAZINE

(71) Applicant: Benjamin Hoffman, West Chester, OH (US)

(72) Inventor: Benjamin Hoffman, West Chester, OH (US)

( * ) Notice: Subject to any disclaimer, the term of this patent is extended or adjusted under 35 U.S.C. 154(b) by 0 days.

(21) Appl. No.: 17/680,372

(22) Filed: Feb. 25, 2022

(51) Int. Cl.
*F41A 9/59* (2006.01)
*F41A 17/38* (2006.01)

(52) U.S. Cl.
CPC ..... *F41A 9/59* (2013.01); *F41A 17/38* (2013.01)

(58) Field of Classification Search
CPC ..... F41A 9/59
See application file for complete search history.

(56) References Cited

U.S. PATENT DOCUMENTS 5,353,537 A * 10/1994 Mercenier ..... F41A 9/59 42/50
7,373,751 B1 * 5/2008 Schaffer ..... F41A 9/65 89/33.1
9,429,377 B2 * 8/2016 Alkhalaileh ..... F41A 9/24
10,012,463 B2 * 7/2018 Warnke ..... F41A 17/38

* cited by examiner

*Primary Examiner* — Reginald S Tillman, Jr.
(74) *Attorney, Agent, or Firm* — R. William Graham

(57) ABSTRACT

The inventive technology describe herein employs a removal assist mechanism for a firearm magazine that eliminates hang-ups and gravitational restrictions and allows consistent, reliable, safe, and dependable magazine ejection from a firearm. This removal assist mechanism is for a firearm having a magazine release actuator. The embodiment of the overall mechanism includes a biasing mechanism connected to the magazine and which extends from the magazine to contact a part of a firearm containing the magazine, wherein the biasing mechanism biases against the firearm part when the magazine is inserted into the firearm and remains under resistive force while the magazine is retained therein, until released by the magazine release actuator whereupon releasing the biasing mechanism assists in ejection of the magazine.

16 Claims, 16 Drawing Sheets

Section A-A

Section A-A

DETAIL A
SCALE 2:1

REMOVAL ASSIST MECHANISM FOR FIRE ARM MAGAZINE

FIELD OF INVENTION

This invention relates to firearms. More particularly, but not by way of limitation, the invention relates to an improvement in a firearm magazine to facilitate quick exchange of the magazine to improve the use and operation of firearms, including rifles, handguns, Pistol Caliber Carbines (PCC), and any firearm capable of utilizing a detachable/interchangeable magazine that feeds ammunition into the firearm. In this regard, the present invention relates to a removal assist mechanism for a firearm magazine, which is configured to more reliably, quickly, easily, effectively, and consistently eject a magazine from a firearm to facilitate an extensively more reliable ejection of a magazine. This enhanced ejection allows for a faster reload of the firearm from the next magazine to be loaded into the firearm. This invention will assist magazine ejection when the firearm is held at any direction or angle. Additional embodiment includes eliminating the need to manually pull a magazine out of a firearm that may become caught in the firearms magazine channel after pressing the firearms magazine release mechanism, thus saving time and additional movement. Considering the time savings, consistency of ejection, and increase in reliability, this invention can save lives and injury in the case of military/police, personal defense, and allow a distinct advantage for competitors in many types of shooting competitions by saving time and additional bodily movement.

BACKGROUND OF THE INVENTION

Many of today's firearms are of a type which employ a magazine carrying multiple rounds of ammunition. Such firearms have a cavity for receiving the magazine containing ammunition which is fed to the firing mechanism for firing from the firearm. Common examples of such firearms include, but are not limited to, Glock, Colt, STI, CZ handguns, AR 15, AK47 rifles, Pistol Caliber Carbines (PCC's), and any other bolt action, semi-auto, select-fire, full-auto, firearm that is or can be fed from a magazine. A common feature to all is they comprise a multiple round magazine that can be configured with various round capacities and various internal and external components. The magazine tube has a shaped, open top from which the rounds are individually fed into the firearm's firing chamber, a spring mechanism having a follower that moves the rounds up the magazine housing to the firing chamber, an open top loading orifice from which rounds are manually loaded into the magazine in which engage and push the spring/follower down into the magazine tube, and a removable closure, e.g., base pad/magazine extension that closes the bottom of magazine and prevents the pressure exerted by the spring and the loaded rounds from falling out of the bottom of the magazine. Most of these firearms require gravity as the main force for the magazine falling free from the firearm when the firearms magazine ejection system is activated, typically by pressing a magazine release button located on the firearm.

Of paramount importance with these types of firearms is the ease of which a magazine can be ejected and then replaced. These types of firearms are commonly utilized by the military, police, competitive shooters, and for personal protection, along with other groups, where the ability to fire multiple rounds from a firearm and then quickly, reliably, and consistently reload the firearm is critical. This ability to quickly reload the firearm without having to manually manipulate the magazine during the magazine ejection due to hang-up or less than ideal firearm position, can determine the outcome of any type of situation requiring use of this type of firearm. For example, when utilized by military, police, or for personal protection, this can mean valuable time saved and the ability to quickly fire the firearm from the next magazine. When utilized in sporting competitions, where a user competes in various firing challenges against other firearm users and/or the clock, this can mean significant decrease in time taken to complete a firing stage. Typically, but not limited to, these competitions test the user's ability to quickly and accurately fire their firearm by generally simulating various real-life military and police situations. Many of these situations require a fast and reliable magazine change, or multiple magazine changes in a scenario. In the military/police or personal protection situations, the high-stress engagement type situations require speed and reliability of the firearm and its subsequent functions. Time is of the essence and a fast, no-hang up, magazine change to allow for a full complement of rounds contained in the new/reloaded magazine, may represent a life-or-death situation where moments spent fumbling or having to pull a magazine from the firearm may result in life threatening consequences. It is also commonly known that in the military/police, personal defense, or competition use of firearms, that the firearms will be exposed to dirt, dust, and other debris which can contaminate the firearms magazine chamber (surfaces on outside of magazine body and inside of firearms magazine channel) and interfere with a subsequent magazine change by not allowing the magazine to fall free from the firearm when the firearms magazine release mechanism is activated, thus requiring time and additional movements to then pull magazine completely from firearms and then replace with the next magazine.

Because the magazine is ejected from the firearm after the user discharges rounds therein, with the magazine often landing on the ground or another debris-laden surface, it is very difficult for the user to avoid exposure of the magazine to debris. If the magazine is loaded back into firearm without properly cleaning, the foreign materials deposited on the magazine can prevent a snag free ejection of the magazine.

Naturally, any issue that causes a time delay during a magazine change, and the subsequent firing of the firearm, can have a serious impact on the user's ability to rely on his or her firearm when the need arises. One of these issues is having to eject a magazine at a less than ideal position. Such as a firearm having to be held sideways due to shooting position constraints. As most firearms depend mainly on gravity for the magazine to eject from firearm, the magazine has to be manually pulled from the firearm before reloading the firearm with a subsequent magazine. This manual extraction takes valuable time and causes additional movements before being able to fire rounds from a new magazine.

Although pre-loaded multiple round magazines can be carried by the firearm user, many circumstances dictate that user have the ability to quickly, tactically, and consistently reload a firearm with a new magazine. When it is possible to depend on the ejection of a magazine in most any shooting scenario, it is possible to fine tune the shooters fine and gross motor skills, along with optimize motions for the magazine ejection while performing the motions for the magazine reload, in order to facilitate the fastest exchange of firearm magazines possible. Resulting in shooting positions that require less movement, and more favorable outcomes for users implementing this removal assist mechanism for the firearms magazine.

The current invention overcomes the limitations of relying on gravity for snag-free, hang-up free magazine ejection. This invention provides a system that overcomes limitations of traditional magazine ejection from a firearm. Creating a solution to the aforementioned issues and problems with traditional magazine ejection. The current invention provides a method that significantly increases the speed and force the ejected magazine leaves the firearm. This system also improves the reliability of magazine ejections along with greatly increase the position that a firearm has to be in to facilitate a drop-free, hang-up free ejection.

SUMMARY OF THE INVENTION

The current invention designs provide a removal assist mechanism for firearm magazines, which incorporates a mechanism as a component or integral components to the firearm magazine. This invention is not limited to the magazine base pads or magazine tube of the firearms magazine. The objects and methods of this design are synonymous with the concept of a removal assist mechanism for a firearm magazine located on or within the magazine or any of the magazine attachments, such as a magazine base, with the assumption a magazine base is considered in these cases to be part of the magazine.

It is an object of the invention to improve firearm magazines.

Another object is to improve the release/ejection of firearm magazines.

Still another object is to provide a removal assist mechanism for a fire arm magazine.

It is also an important object of the present invention to provide an improved removal assist mechanism that can be manufactured out of a wide variety of different materials, including aluminum, plastic, plastic composites, steel, brass, titanium, tungsten, and any other viable material, which can give the required performance characteristics for the application. Typically, but not limited to, characteristics such as durability, impact resistance, weight, wear characteristics, machinability.

It is also an object of the present invention to provide a removal assist mechanism for a firearm magazine that is adaptable to a wide variety of different sizes and configurations of magazines that are used for a variety of different firearms, including rifles, Pistol-caliber carbines (PCCs), and handguns.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

Accordingly, one aspect of the invention is directed to a removal assist mechanism for a magazine. The removal assist mechanism for a magazine includes a biasing mechanism connected to the magazine, or a component of a magazine, and which extends from the magazine to contact a part of a firearm containing the magazine, wherein the biasing mechanism biases against the part when the magazine is inserted into the firearm and remains under resistive force while the magazine is retained therein until released by the magazine release actuator whereupon releasing/actuating the biasing mechanism assisting in ejection of the magazine.

One preferred removal assist mechanism includes a housing which has a bottom wall, front wall, rear wall, a first side wall, a second side wall, and top portion. In the case of a hand gun magazine, a slotted surface is formed beneath the top portion to enable sliding onto the bottom lip of a standard handgun magazine tube in much the same manner as a standard base pad.

The first side wall has a first recessed surface with threaded apertures to receive a complementary formed side wall plate having orifices which can be co-aligned with threaded apertures of the first side wall permitting threaded connection of the same using screws. A second recessed surface is inwardly formed to movably receive a cam lever therein. The second recessed surface has a first slotted surface running generally parallel to the bottom wall and a second slotted surface running generally perpendicular to the first slotted surface. A pin receiving surface is disposed adjacent to the slotted surfaces.

The side wall plate includes complementary formed a first slotted surface and a second slotted surface running generally perpendicular to the first slotted surface and can be co-aligned with respect to the first slotted surface and second slotted surface of the first side wall. A similarly formed pin receiving surface can be formed adjacent to slotted surface of the side wall plate.

The cam lever has a forked lower extending end and an upper arm with a notched surface. The forked end has a pin receiving surface extending transversely therethrough and the arm has a pin receiving surface extending transversely through the notched surface. Pins extend respectively through pin receiving surfaces of the cam lever. In this regard, the cam lever and pins can be movably seated in the slotted surfaces of the first side wall and side wall plate, respectively. The length, starting point and ending point of the slotted surfaces can determine the starting and stopping points of the pin. In turn, allowing adjustments to travel of the corresponding components.

A plunger is provided which includes a lower end with a notched surface and a pin receiving surface extending transversely through the notched surface. The pin receiving surface is similarly sized and configured to pin receiving surface of the cam leaver and the pin extends through pin receiving surfaces when notched surface are disposed against each other. An upper end of the plunger can be complementary formed for contact purposes with a part of the firearm.

A biasing element is provided to bias the plunger against the part of the firearm and provides assistance in the ejection of the magazine, but does so in a manner whereby the cam lever assists in controlling the force applied during the ejection.

DETAILED DESCRIPTION OF PREFERRED EMBODIMENT

Figure 1A:
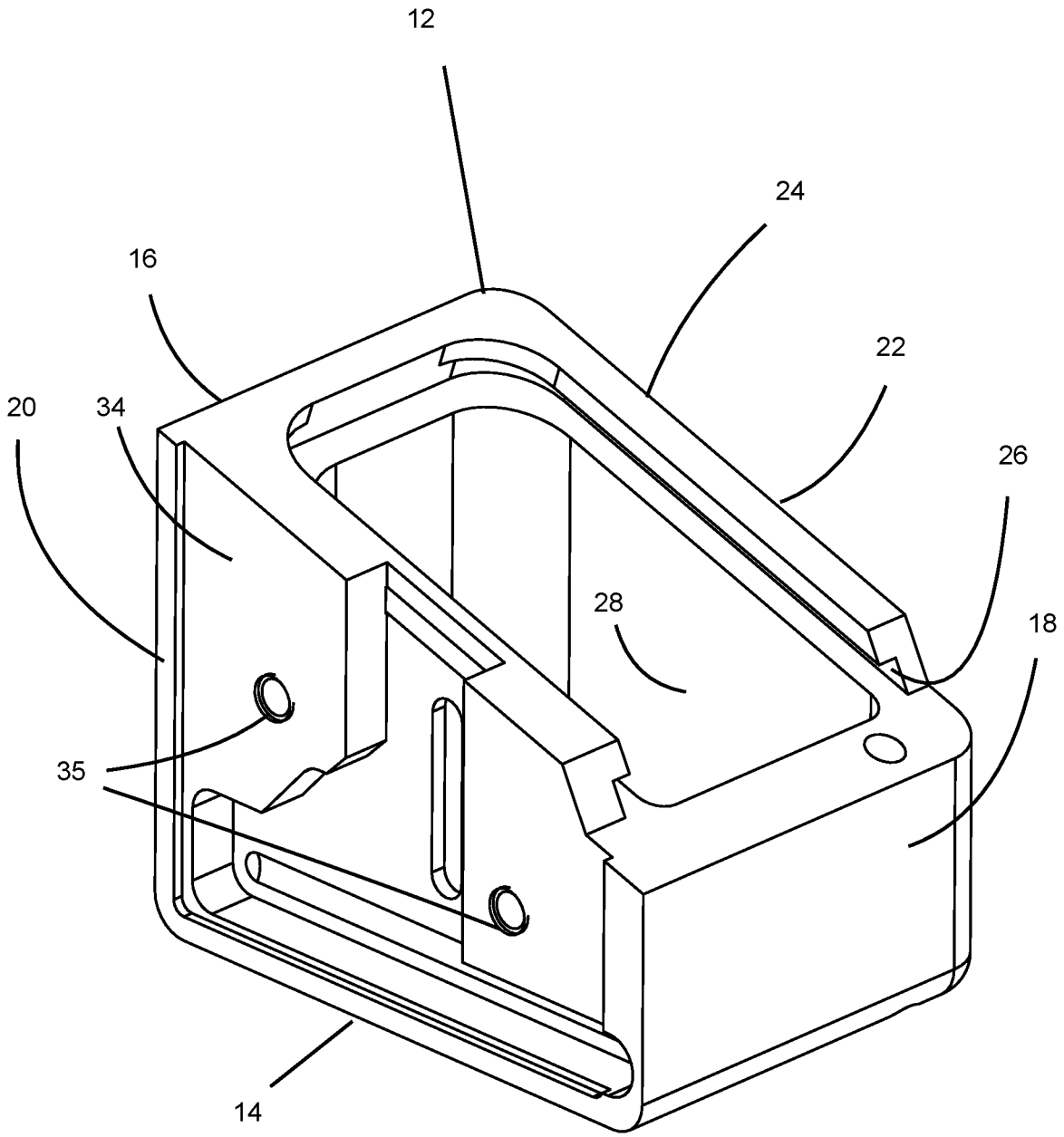
FIG. 1A is a perspective view a base pad of the invention.
Figure 1B:
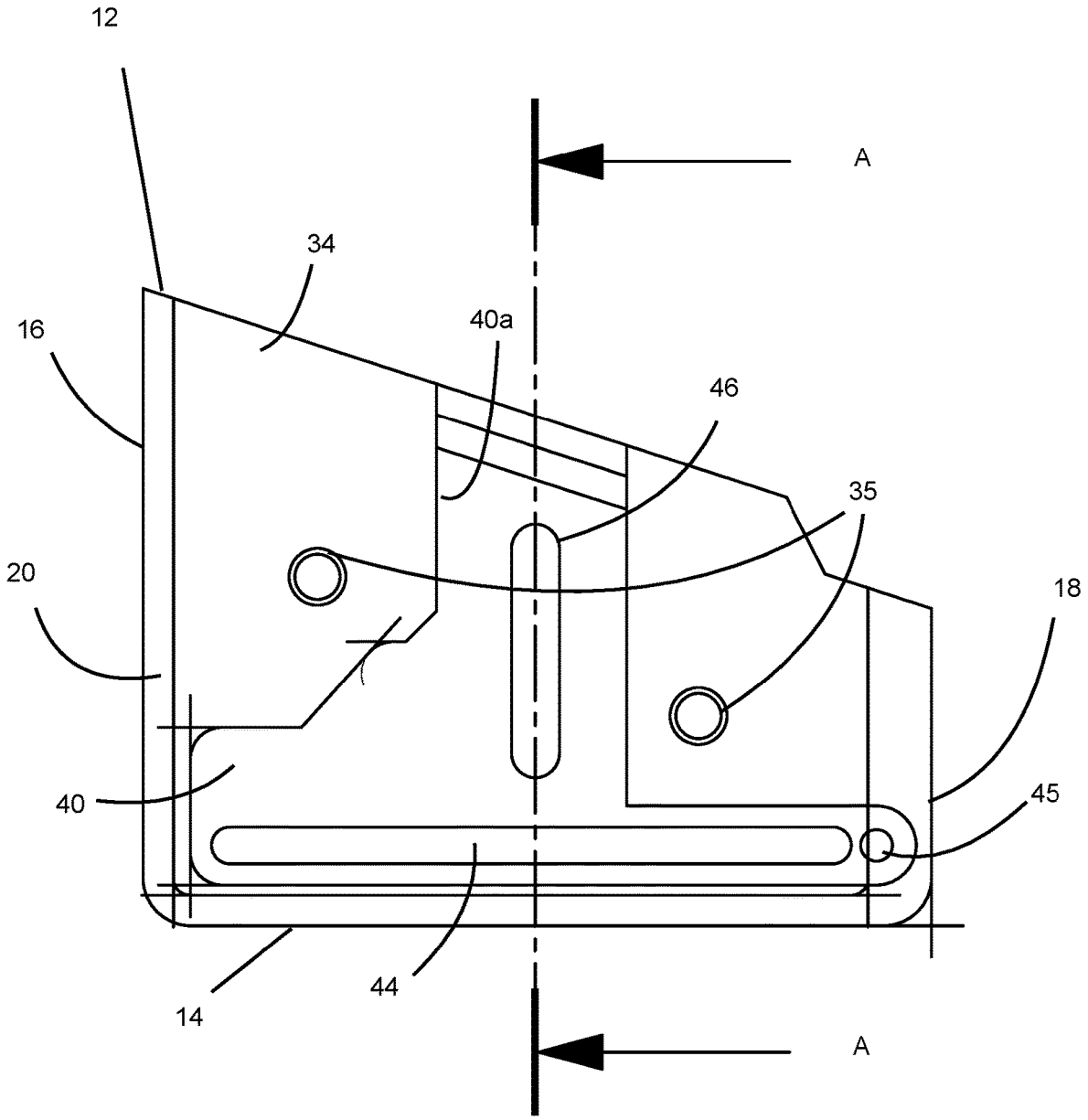
FIG. 1B is a side view of FIG. 1A.
Figure 1C:
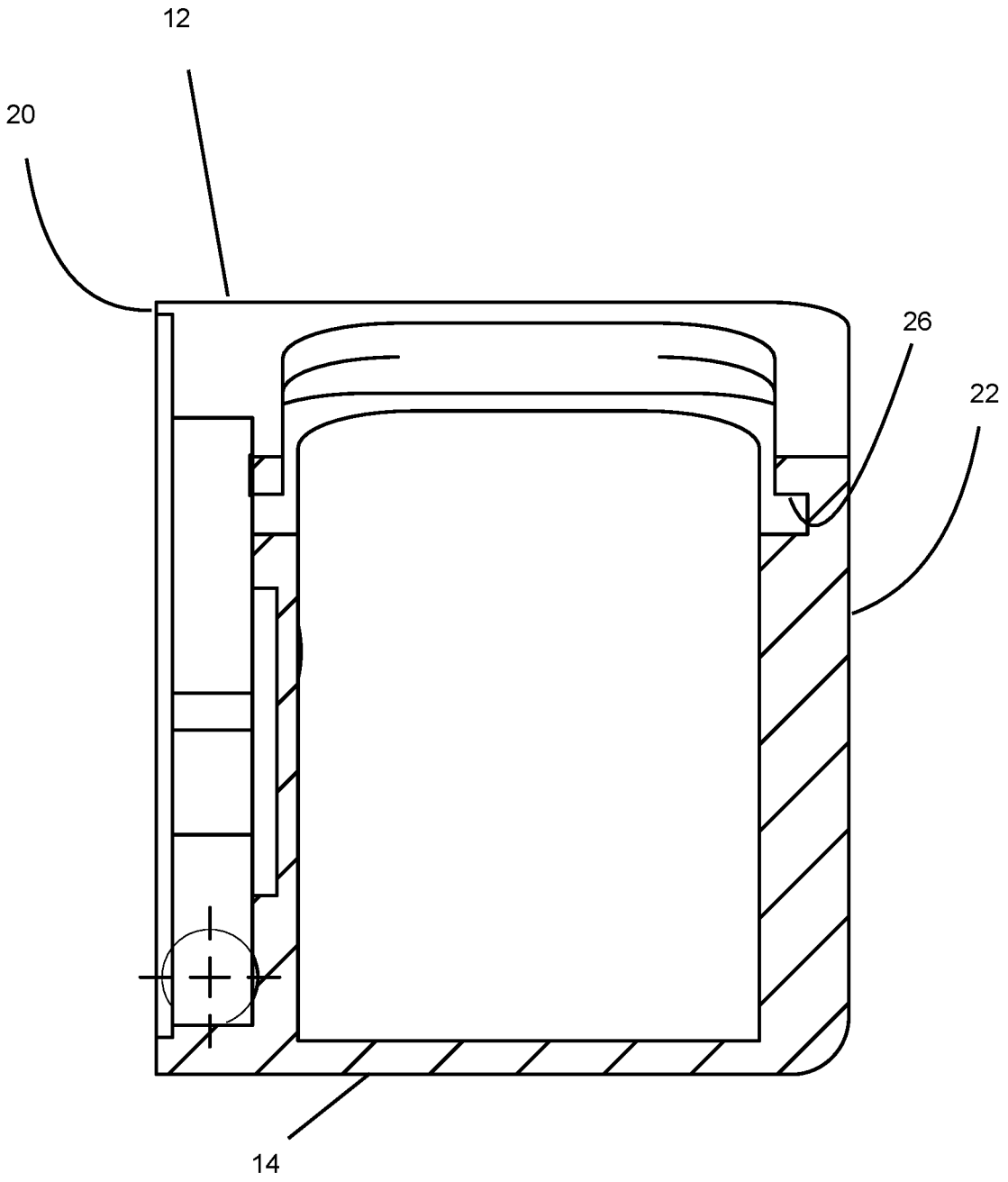
FIG. 1C is a sectional view from Line A-A through FIG. 1B.
Figure 2A:
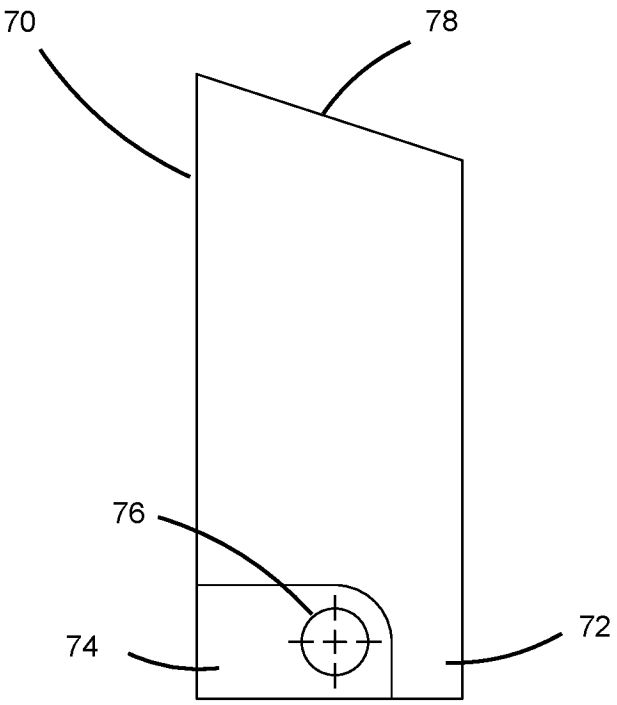
FIG. 2A is a plan view of a plunger of the invention.
Figure 2B:
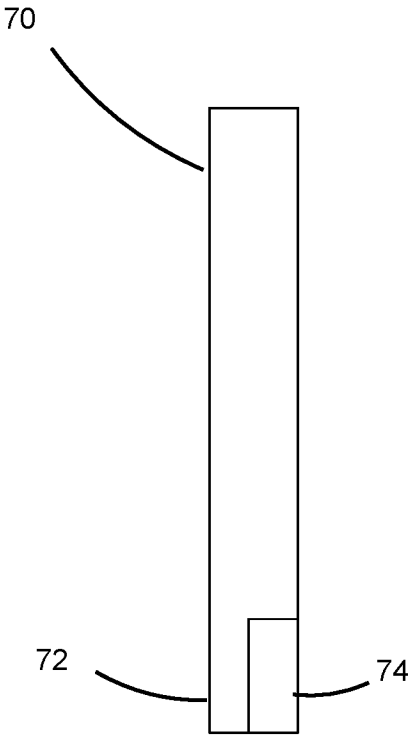
FIG. 2B is left side view of FIG. 2A.
Figure 3C:
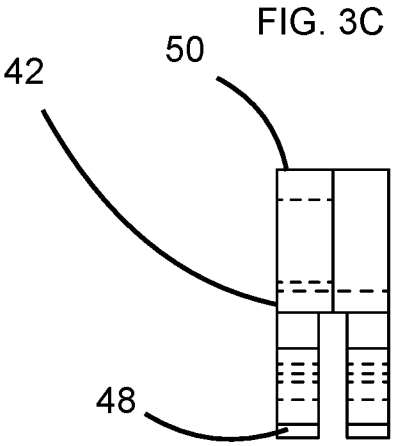
FIG. 3C is a right end view of FIG. 3A.
Figure 3B:
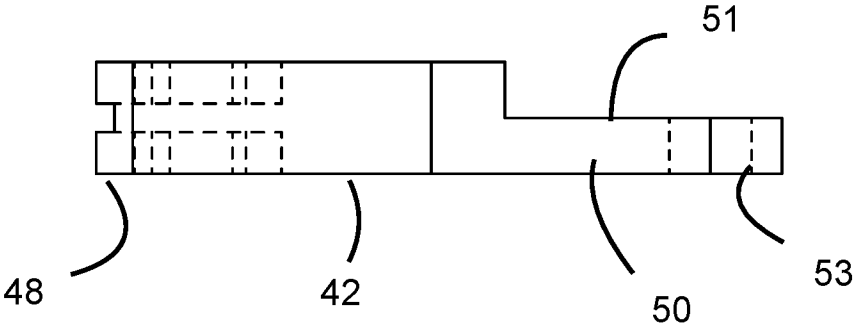
FIG. 3B is a top side view of FIG. 3A.
Figure 3A:
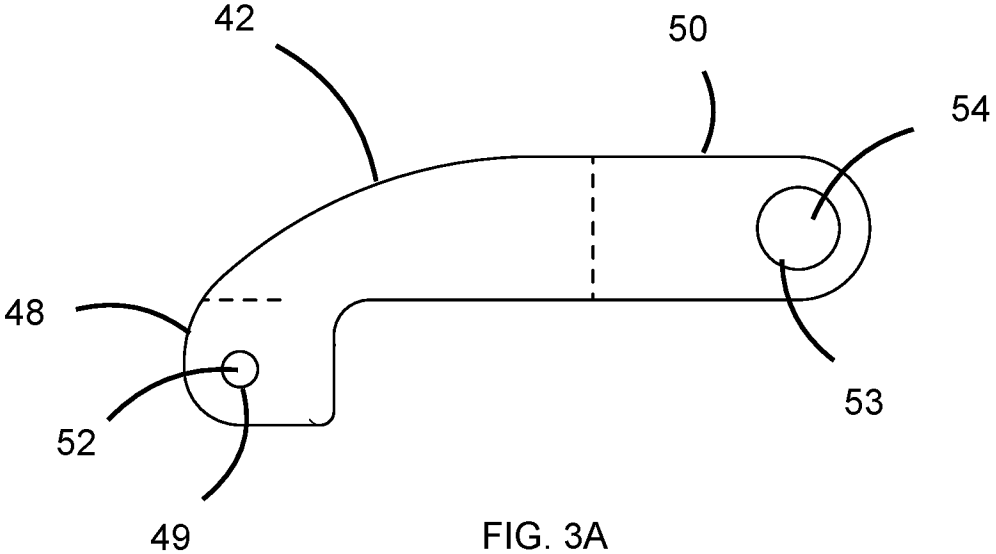
FIG. 3A is a plan view of a cam lever of the invention.
Figure 4B:
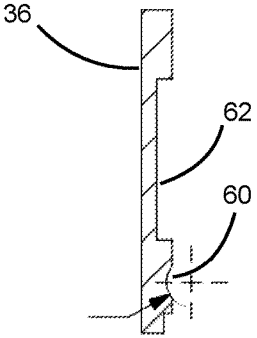
FIG. 4B is a sectional view from Line A-A through FIG. 4A.
Figure 4C:
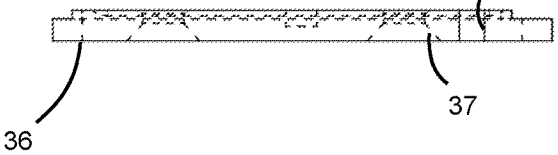
FIG. 4C is a top view of FIG. 4A.
Figure 4A:
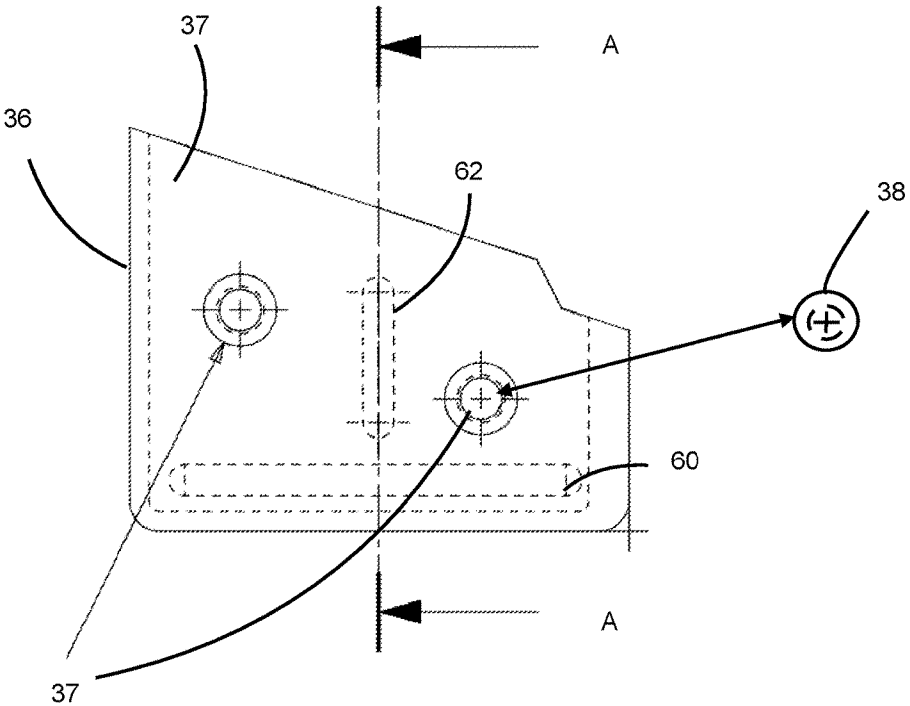
FIG. 4A is a plan view of a side plate of the invention.
Figure 5A:
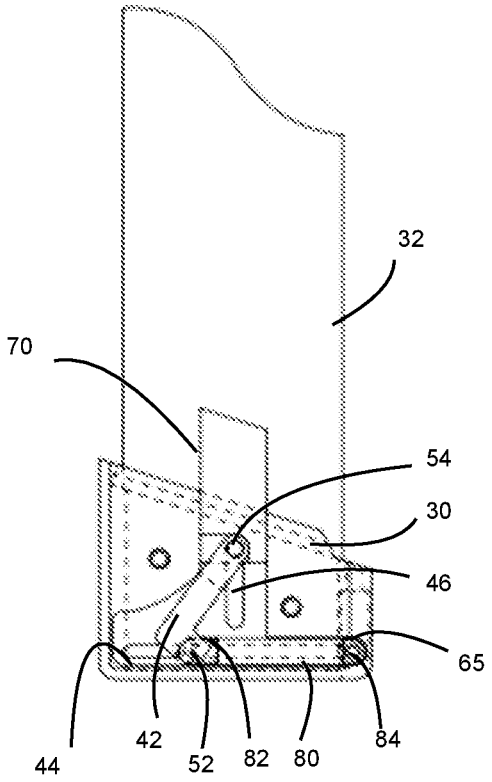
FIG. 5A is a side plan view of a part of the invention in an extended mode.
Figure 5B:
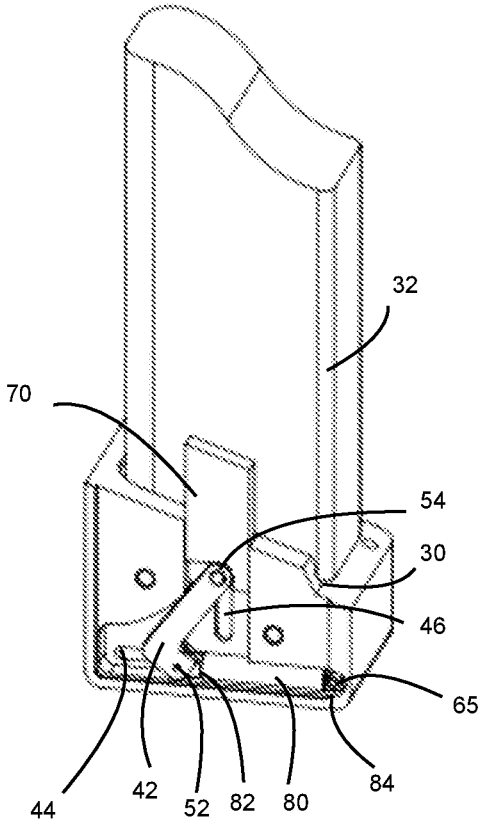
FIG. 5B is a perspective view of FIG. 5A.
Figure 6A:
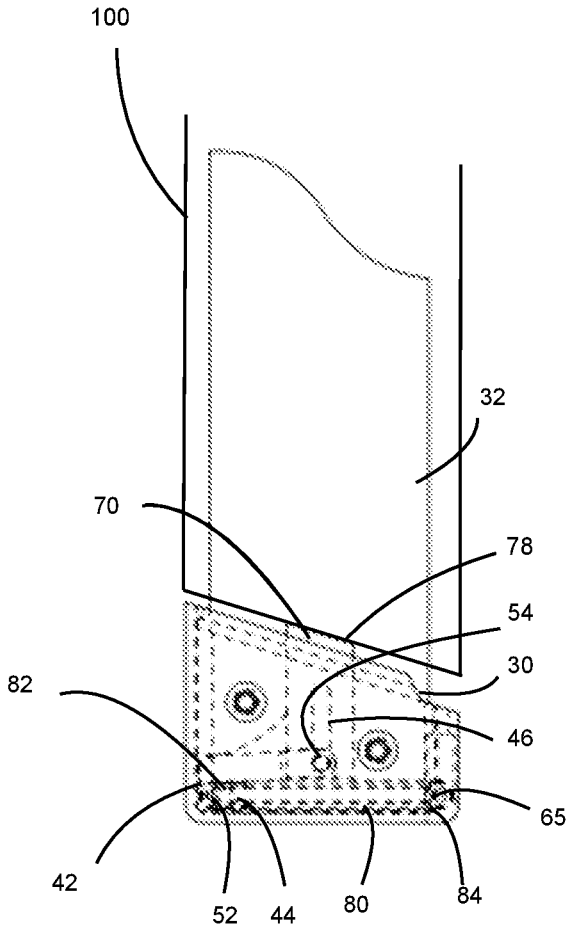
FIG. 6A is a plan view of a part of the invention in a retracted mode.
Figure 6B:
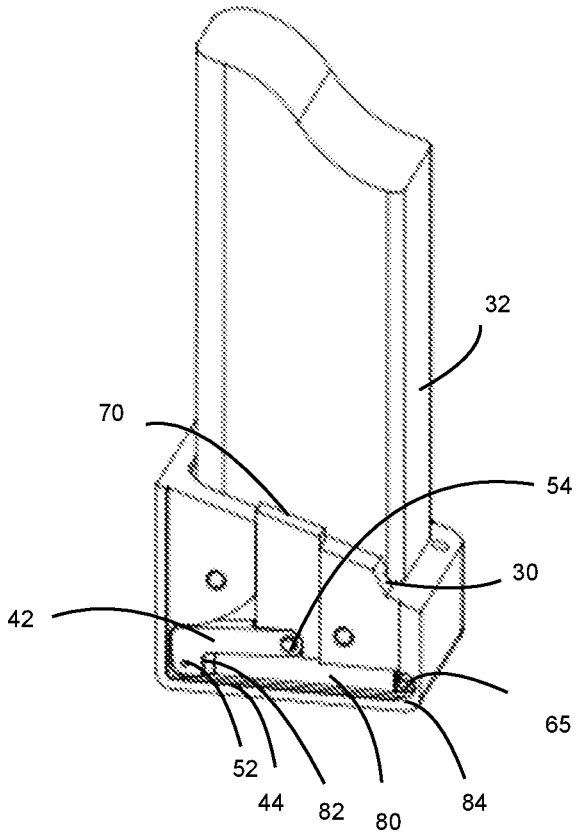
FIG. 6B is a perspective view of FIG. 6A.

Referring now to the instant invention, a removal assist mechanism for a magazine is generally designated by the numeral 10. Like parts are like numbered throughout the embodiments. The removal assist mechanism for a magazine 10 in an exemplary embodiment includes a base pad housing 12 which has a bottom wall 14, front wall 16, rear wall 18, first side wall 20, second side wall 22 and top portion 24.

The base pad housing 12 is configured with a slotted surface 26 formed beneath the top portion 24 to enable sliding onto a lip 30 at a bottom of a standard magazine tube 32 in much the same manner as a standard base pad. There is a central open surface 28 defined in the based pad 12.

The first side wall 20 has a first recessed surface 34 with threaded apertures 35 to receive a complementary formed side wall plate 36 having orifices 37 which can be co-aligned with threaded apertures 35 permitting threaded connection of the same using screws 38. A second recessed surface 40 is inwardly journaled to movably receive a cam lever 42 therein. The second recessed surface 40 has a first slotted surface 44 running generally parallel to the bottom wall 14 and a second slotted surface 46 running generally perpendicular to the first slotted surface 44. A pin receiving surface 45 is disposed adjacent slotted surface 44.

The side wall plate 36 includes a recessed surface 37 having complementary formed a first slotted surface 60 and a second slotted surface 62 running generally perpendicular to the first slotted surface 60 and can be co-aligned with respect to the first slotted surface 44 and second slotted surface 46. A similarly formed pin receiving surface 63 can be formed adjacent slotted surface 60 which also can be aligned with pin receiving surface 45.

The cam lever 42 has a forked lower extending end 48 and an upper arm 50 with a notched surface 51. The forked end 48 has a pin receiving surface 49 extending transversely therethrough and arm 50 has a pin receiving surface 53 extending transversely through the notched surface 51. Pins 52 and 54 extend respectively through pin receiving surfaces 49 and 53. In this regard, the cam lever 42 with pins 52 and 54 can be movably seated in the slotted surfaces 44, 60 and 46, 62, respectively.

A plunger 70 can be movably, preferably slidably seated in a portion 40*a* of surface 40 and includes a lower end 72 with a notched surface 74 and a pin receiving surface 76 extending transversely through the notched surface 74. The pin receiving surface 76 is similarly sized and configured to pin receiving surface 53 and pin 54 extends through pin receiving surface 76 and correspondingly aligned pin receiving surface 53 when the notched surface 51 is disposed against notched surface 74. An upper end 78 can be complementary formed to seat against the handle, here shown pitched, for purposes of contacting a handle housing surface of firearm 100.

A spring retaining pin 65 can be disposed in pin receiving surfaces 45 and 63. Pins 52 and 54 are inserted through the cam lever 42 and into respective slotted surfaces 44, 60 and 46, 62. A spring 80 can be operably disposed between slotted surfaces 44 and 60 and has ends 82, 84 connected about respective pins 52 and 65. In this regard, the spring 80 serves to bias the cam lever 42 and in turn plunger 70 upwardly thereby assist in the ejection of the magazine 32. Note, the instant invention provides assistance in the ejection of the magazine 32, but does so in a manner whereby the cam lever 42 assists in controlling the force applied during the ejection.

Thus, the invention provides a mechanism which in this example is connected as a base pad, but it is contemplated that the mechanism can be employed as a cuff about a magazine, or molded-in a magazine, in the case of use on a rifle, PCC, or any firearm utilizing a magazine/long tube/high-capacity magazine, that extends its length beyond the bottom of the firearms magazine containment area. In either case, this improves the ejection of a box/rotary/any type of magazine from any firearm.

Figure 7A:
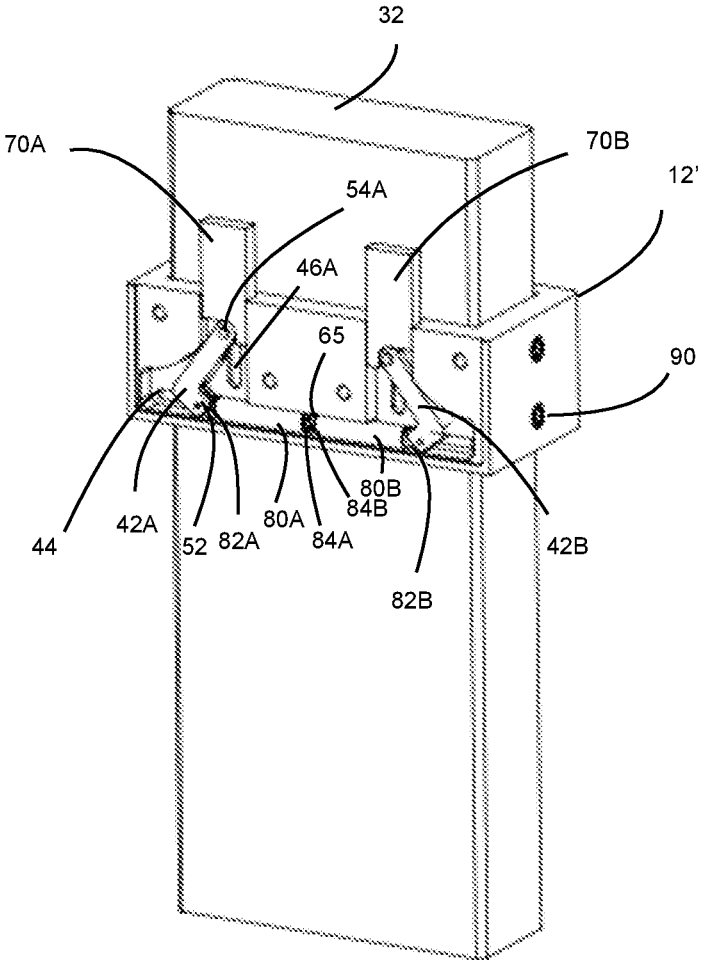
FIG. 7A is a perspective view of another embodiment showing part of the invention in an extended mode.
Figure 7B:
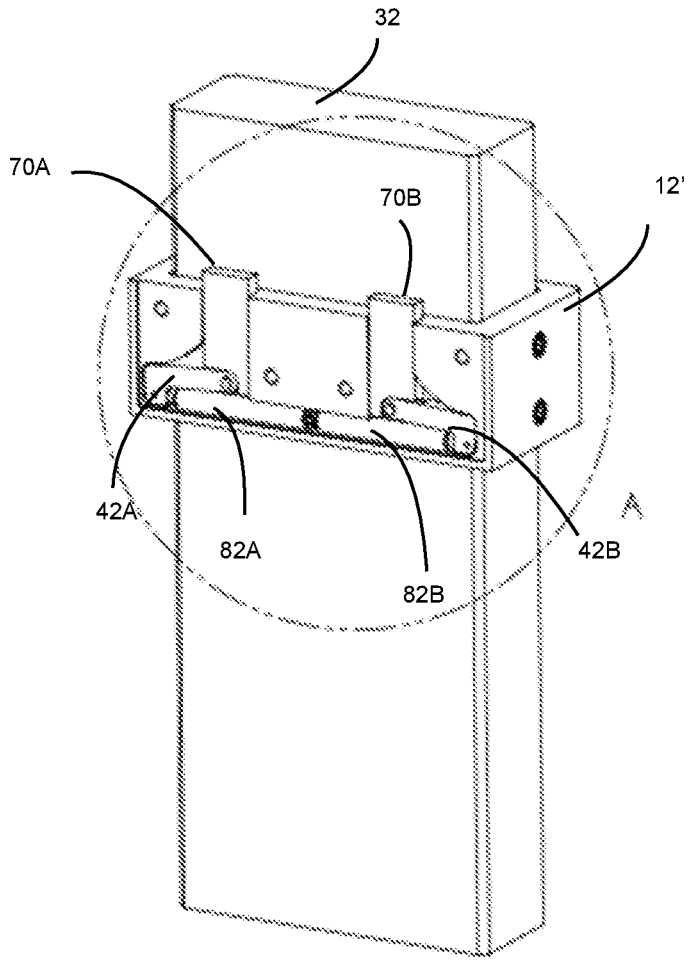
FIG. 7B is a perspective view of another embodiment showing part of the invention in an extended mode.
Figure 7C:
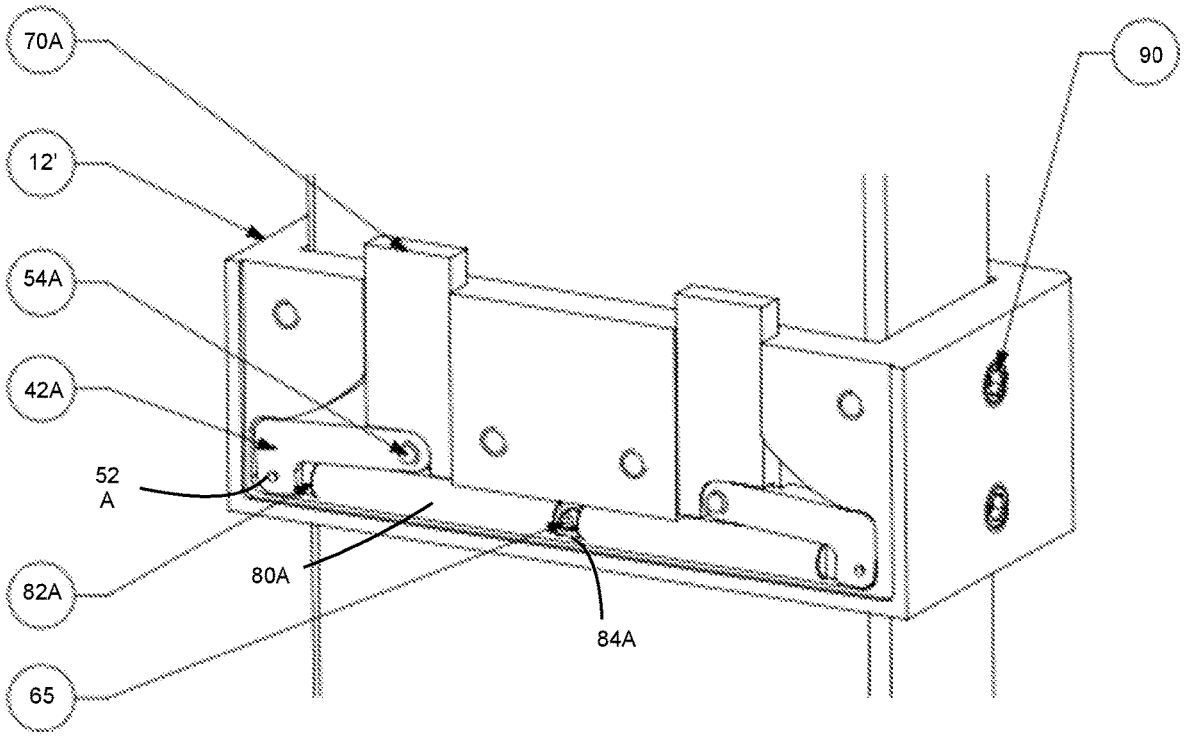
FIG. 7C is an enlarged area A from FIG. 7B.

In FIGS. 7A-7C, there is shown an embodiment wherein a cuff housing 12' includes two similarly formed mechanisms as described above. Here, there are cam levers 42A and 42B which mirror one another and operate plungers 70A and 70B in a similar manner as described above wherein respective springs 82A and 82B bias the same. The cuff housing in this embodiment is shown connected to the magazine 32 via threaded set screw connections 90.

Figure 8C:
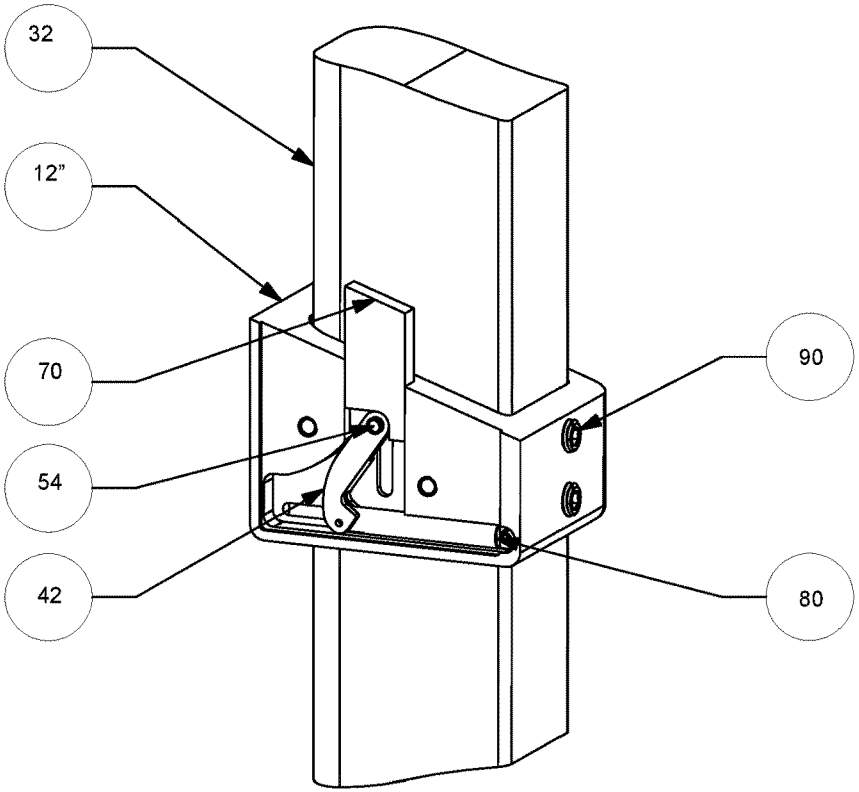
FIG. 8C is a perspective view of FIG. 8B.
Figure 8B:
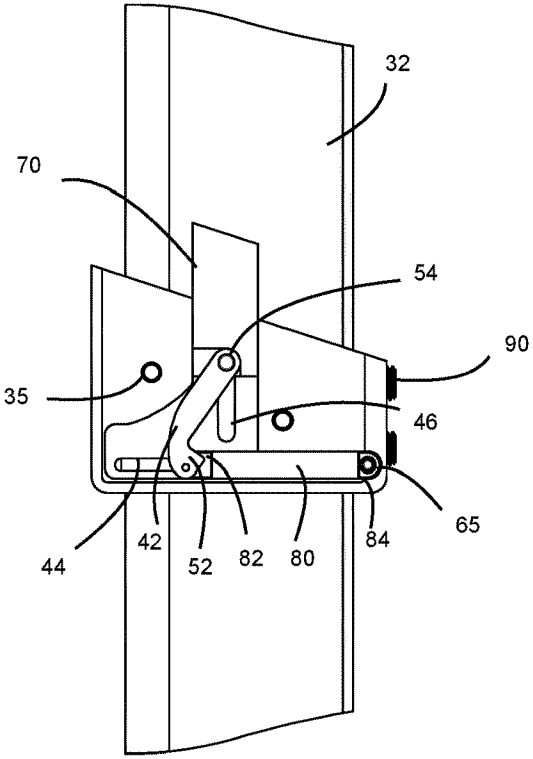
FIG. 8B is a side view of FIG. 8A without a cover revealing parts thereof.
Figure 8A:
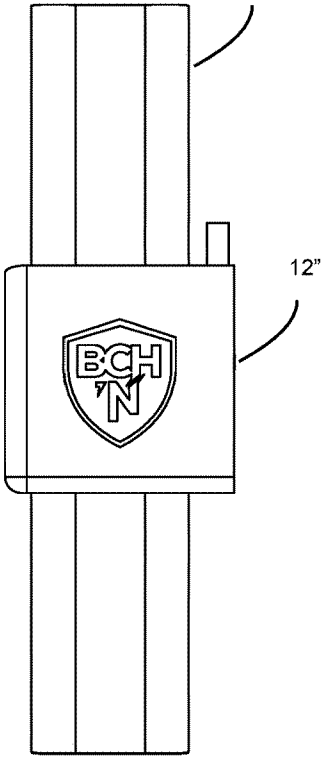
FIG. 8A is a left end view another embodiment of the invention.
Figure 9C:
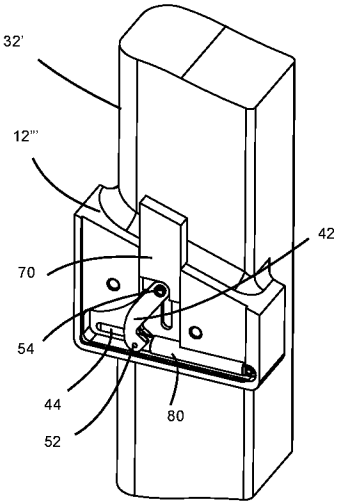
FIG. 9C is a perspective view of FIG. 9A.
Figure 9B:
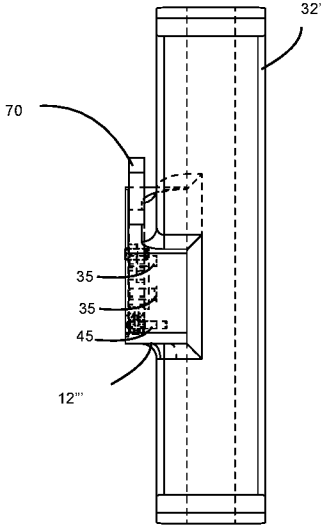
FIG. 9B is a right end view of FIG. 9A.
Figure 9A:
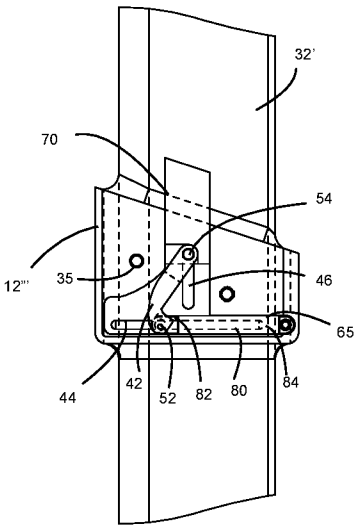
FIG. 9A is a side view another embodiment of the invention without a cover revealing parts thereof.

Similarly, In FIGS. 8A-8C, there is shown an embodiment wherein a slip over cuff housing 12" includes one similarly formed mechanism as described above. The cuff housing in this embodiment is shown connected to the magazine 32 via threaded set screw connections 90. In FIGS. 9A-9C, there is shown an embodiment wherein an integrally molded cuff housing 12" is formed as part of the magazine 32' with one similarly formed plunger mechanism as described above incorporated therein. This embodiment envisions a replacement magazine for a firearm.

Figure 10C:
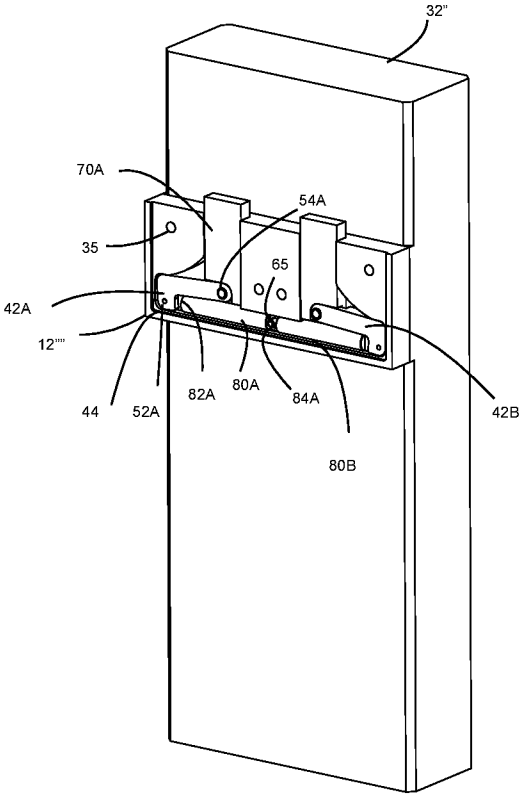
FIG. 10C is a perspective view of FIG. 10A.
Figure 10B:
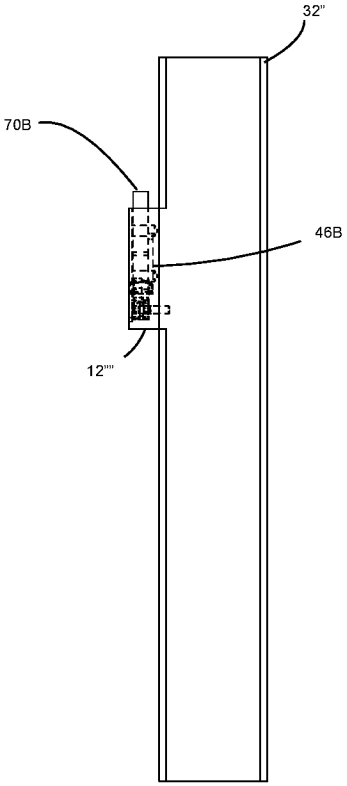
FIG. 10B is a right end view of FIG. 10A.
Figure 10A:
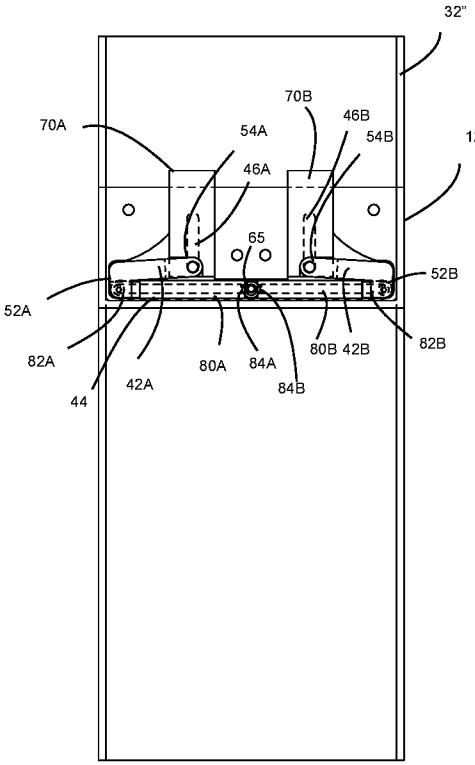
FIG. 10A is a side view another embodiment of the invention without a cover revealing parts thereof.

Similarly, In FIGS. 10A-10C, there is shown an embodiment wherein an integrally molded cuff housing 12"" is formed as part of the magazine 32" with two similarly formed plunger mechanisms as described above incorporated therein.

This system improves the speed of the magazine ejection to allow for more rapid reloading of the firearm in situations where less time saves lives. This can also be related to competitive shooting and defensive situations where if a magazine can drop free and quickly, it can save valuable time in order to reload a firearm or change the magazine for any other reason.

Further, the invention helps eliminate magazine hang-ups in firearms that cause a magazine to stick in the firearm and results in having to remove the magazine manually. The invention allows magazine ejection at nearly any angle the firearm is held, thus aiding in speed of reloading the firearm.

The invention increases the safety aspect of a firearm as the firearm does not have to be manipulated as much when changing mags. The invention prevents having to move or bring down the firearm while changing mags and eliminates many added movements required to change mags if one is caught in the firearms mag channel and does not eject free from the firearm.

The invention adds forces to eject the magazine in addition to gravitational forces typically required. While a spring mechanism is shown and described, it is contemplated that the biasing member can be done with an electronic or magnetic means which assist in the ejection, or biasing of the plunger. It is also contemplated that the invention could be an independent or integral part of a magazine. It is also contemplated that the mechanism can be energized by any other spring type or mechanical lever/limb/cam.

As the magazine is inserted into the firearms magazine channel, the lift comes into contact with the firearm frame, magazine well, location point, receiving area for the lift. Upon contact to that area, the lift begins its travel and engages the lift and spring mechanisms that energize the system as the magazine continues to be inserted into the firearm. Lift and spring mechanisms can be adjusted in height, length, angle, etc . . . in order to give different pressures, spring tensions, and energy curves in order to allow for specialized tuning to particular firearm.

The mechanism can also be previously energized and then inserted into the firearm. This mechanism can then be turned on upon or after the magazine has been seated, or have a set engagement point to engage the system at a certain point in the insertion process for the subsequent future ejection of the mag.

This mechanism might also be engaged with a mag release mechanism on the particular firearm. The typical configuration of this invention will have slight pressure on the lift engaged on the opposing surface (frame, magwell, etc . . . ), when the magazine is held in place in the firearm by the firearms magazine retention/release mechanism. Once the magazine is released from the mechanism that retains the magazine in the firearm, the invention takes over and complements any gravitational energy, or opposes it if say the firearm is at an angle where the magazine is not in a favorable gravity release position. The spring tension on the mechanism applies additional force to the ejection process. This propels the magazine out of the firearm at a greater speed and a longer travel of applied force, that would not be present without this mechanism.

This will allow to clear the magazine from the firearm without hang ups, and at a much greater speed than gravity alone. This will allow for faster magazine changes in both combat/defensive situations along with competitive shooting sports.

The design can configure any number of force curves throughout the movement of the mechanism by varying design aspects. One aspect of the design discussed decreases the force of the removal assist mechanism when the magazine is held in the firearm by the firearms magazine retention mechanism. This in turn does not place significant pressure on the firearms magazine retention system so it does not significantly impact (increase) the force it takes to actuate the firearms release button in order to facilitate the ejection of the magazine.

Another inherent aspect of this design will eliminate magazine movement. This will help reduce noise made by the firearm if it has a loose fitting magazine. This is especially important in military/police stealth operations. This system will also help keep the firearms magazines from over extending into the firearm (example of resting firearm on magazine to steady it for a shot). This can cause malfunctions as the magazine is often pushed into the firearms extraction, ejection, and loading components, such as a slide, bolt, or bolt carrier, for some examples.

The invention can be a "machined" or "mold-in" type of mechanism on any type of mag, such as PCC mags, AR mags, AK mags. These could be injection molded, or any other type of process as part of the mag body. The invention can be implemented with any type of cylindrical mag system such as Ruger rotary mags, Magpul rotary mags, and others. Suitable material of construction includes steel, aluminum, alloy or plastics, but can be any material capable of producing a functional mechanism as described.

While the invention provides a simple mechanism employing a spring to increase tension to mag release push when depressed, alternative biasing assist mechanisms can be envisioned. These might use magnetic opposing poles, a gas pressure mechanism, electric biased system for example. Additionally, a spring can be adjusted to adjust to increase or decrease tension as well as pin locations to hold spring ends. For any push springs, any type of mechanism to increase or decrease spring tensions such as a screw or set screw etc . . . can be employed. Multiple locations for pins that hold springs Single, Dual type, or any number of mechanisms, or any number of various mechanisms, such as a spring in the ejection mechanism to lengthen the push/pull or increase tension, leaf springs, V springs, etc. . . . Opposite of this mechanism on the magazine, would be this mechanism on the gun that receives the magazine being pushed in.

In the case of a magazine base application, the base does not have to increase the capacity of the magazine or increase the overall length of what would be considered a factory magazine.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A removal assist mechanism for a magazine for a firearm having a magazine release actuator, which comprises:

a biasing mechanism connected to the magazine and which extends from the magazine to contact a part of a firearm when containing the magazine, wherein said biasing mechanism biases against the part when the magazine is inserted into the firearm and remains under resistive force while the magazine is retained therein until released by the magazine release actuator whereupon releasing said biasing mechanism assists in ejection of the magazine, wherein said biasing mechanism includes housing having a movably disposed plunger therein which is biased by a spring.

2. The removal assist mechanism of claim 1, wherein said biasing mechanism is characterized to be removably connected to the magazine.

3. The removal assist mechanism of claim 1, which further includes a cam lever therein interconnecting said spring and said plunger.

4. The removal assist mechanism of claim 1, wherein housing surrounds part of said magazine.

5. The removal assist mechanism of claim 1, wherein said biasing mechanism is characterized to be operably connected to an integral housing part of a magazine.

6. The removal assist mechanism of claim 5, which further includes a cam lever therein interconnecting said spring and said plunger.

7. The removal assist mechanism of claim 1, which includes a plurality of said biasing mechanisms.

8. The removal assist mechanism of claim 2, which includes a plurality of said biasing mechanisms.

9. The removal assist mechanism of claim 5, which includes a plurality of said biasing mechanisms.

10. A magazine for a firearm, which includes:

a magazine configured to release from a firearm by a firearm release actuator; and a removal assist mechanism including a biasing mechanism connected to said magazine and which extends from the magazine to contact a part of a firearm when containing said magazine, wherein said biasing mechanism biases against the part when said magazine is inserted into the firearm and remains under resistive force while said magazine is retained therein until released by said magazine release actuator whereupon releasing said biasing mechanism assists in ejection of said magazine, wherein said biasing mechanism includes housing having a movably disposed plunger therein which is biased by a spring.

11. The removal assist mechanism of claim 10, wherein said biasing mechanism is characterized to be removably connected to the magazine.

12. The removal assist mechanism of claim 11, which further includes a cam lever therein interconnecting said spring and said plunger.

13. The removal assist mechanism of claim 10, wherein housing surrounds part of said magazine.

14. The removal assist mechanism of claim 10, wherein said biasing mechanism is characterized to be operably connected to one of a removable and an integral housing part of a magazine.

15. The removal assist mechanism of claim 10, which includes a plurality of said biasing mechanisms.

16. The removal assist mechanism of claim 14, which includes a plurality of said biasing mechanisms.

* * * * *